United States Patent [19]

Gryctko et al.

[11] 3,980,845

[45] Sept. 14, 1976

[54] CIRCUIT BREAKER OPERATOR WITH DEFEATES INTERLOCK MECHANISM

[75] Inventors: Carl E. Gryctko, Haddon Heights, N.J.; Kenneth D. Ball, Warminster, Pa.

[73] Assignee: I-T-E Imperial Corporation, Spring House, Pa.

[22] Filed: Mar. 4, 1975

[21] Appl. No.: 555,166

[52] U.S. Cl. ..... 200/50 A

[51] Int. Cl.[2] ..... H01H 9/22

[58] Field of Search ..... 200/50 A, 153 R, 153 L, 200/153 LB, 330

[56] References Cited

UNITED STATES PATENTS

| | | | |
|---|---|---|---|
| 2,695,934 | 11/1954 | Wills | 200/50 A |
| 2,851,548 | 9/1958 | Edmunds | 200/50 A |
| 2,866,864 | 12/1958 | Giessner et al. | 200/50 A |
| 2,882,359 | 4/1959 | Edmunds et al. | 200/50 A |
| 3,009,029 | 11/1961 | Bodenschatz et al. | 200/330 X |
| 3,313,896 | 4/1967 | Gray | 200/50 A |
| 3,324,259 | 6/1967 | Chamberlin, Jr. et al. | 200/50 A |
| 3,382,331 | 5/1968 | Jencks et al. | 200/50 A |
| 3,657,497 | 4/1972 | Homberg et al. | 200/50 A |
| 3,848,102 | 11/1974 | Jencks et al. | 200/50 A X |

*Primary Examiner*—James R. Scott

*Attorney, Agent, or Firm*—Ostrolenk, Faber, Gerb & Soffen

[57] ABSTRACT

A rotary handle operator mechanism is fixedly mounted in an enclosure having a circuit interrupter mounted therein on the rear wall thereof. The mechanism includes a main handle disposed outside the enclosure for manual operation and being keyed to a cam unit engaged with the circuit breaker handle. A latch unit, including a cover latch section, is provided with a notch formation and a cam formation that cooperate with a forwardly extending pin of the cam unit to provide a switch interlock and a cover latch release.

10 Claims, 9 Drawing Figures

CIRCUIT BREAKER OPERATOR WITH DEFEATES INTERLOCK MECHANISM

In general, this invention relates to rotary handle operators for switch units mounted in an enclosure and more particularly relates to an operator mechanism of this type for relatively large molded case circuit breakers.

U.S. Pat. No. 3,697,714 issued Oct. 10, 1972, to Gryctko et al., for a Rotary Handle Operator With Reversible Cover Latch, illustrates a rotary handle mechanism mounted on a circuit interrupter disposed within an enclosure and mounted on the back wall thereof. The mechanism is provided with a rotary handle which extends through an opening in the enclosure cover when the latter is in a closed position, so that the handle is operable from outside the enclosure. A defeatable cover interlock is provided to prevent unauthorized persons from opening the enclosure cover when the circuit interrupter is closed and a defeatable switch interlock is provided to prevent accidental closing of the circuit breaker when the enclosure cover is open. Handle locking means is provided to prevent unauthorized handle operation.

In accordance with the instant invention, a rotary operator mechanism construction is provided which includes all of the foregoing features. As will hereinafter be seen, the construction of the instant invention results in a rugged mechanism that is adapted for use with relatively large molded case circuit breakers. This construction results in a reduced number of parts and simplified assembly.

In particular, the construction of the instant invention includes a unitary mounting frame constructed with substantially open sides to permit visual observation of the mechanism position, and when the mechanism is utilized with an uncovered switch, contact position may be observed readily. The operator mechanism also includes a main operating handle positioned in front of the frame and having a portion extending therethrough to drive a cam unit that is operatively engaged with the circuit breaker handle. A cover latch unit is provided to cooperate with the cam unit and the enclosure cover to achieve both cover and switch interlock functions.

Accordingly, a primary object of the instant invention is to provide a novel construction for a rotary handle operator.

Another object is to provide a rotary operator that is of rugged construction and is adapted for use with relatively large-sized molded case circuit breakers.

Still another object is to provide a rotary operator of simplified construction.

A further object is to provide a rotary operator having substantially open sides to permit visual observation of switch contacts.

A still further object is to provide a rotary operator having provisions for field installation of auxiliary switches.

These objects as well as other objects of this invention shall become readily apparent after reading the following description of the accompanying drawing in which:

In FIG. 7 the mechanism elements are shown in the switch ON position, and in FIG. 8 the elements are shown in the switch OFF position.

Figure 1:
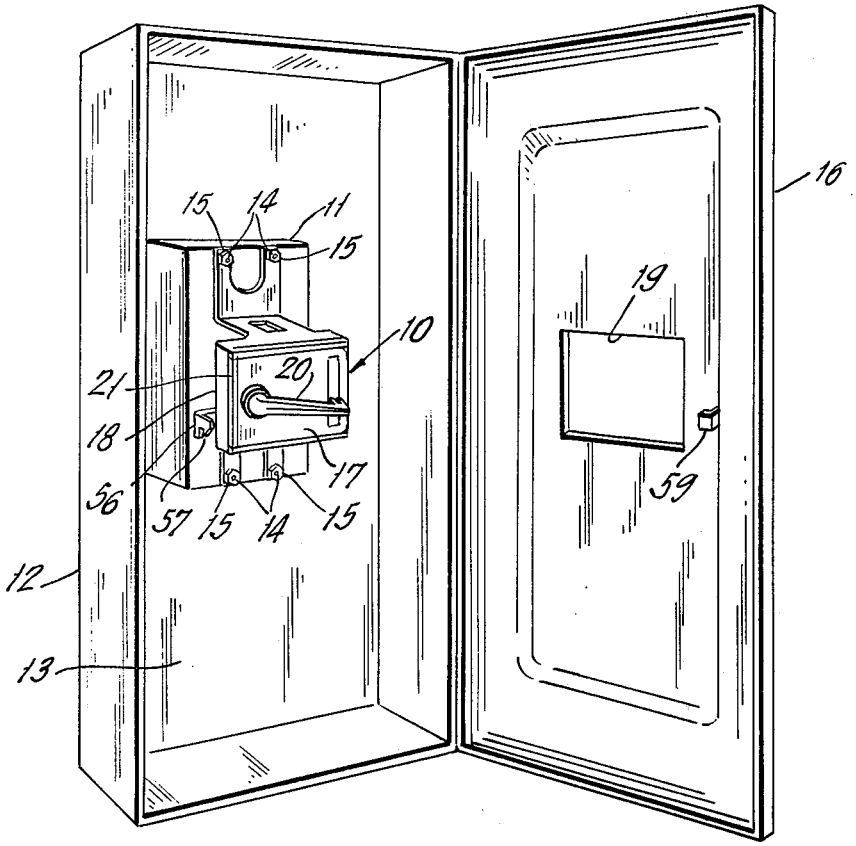
FIG. 1 is a perspective of an enclosure mounted molded case circuit breaker utilizing a rotary handle operator mechanism constructed in accordance with teachings of the instant invention.
Figure 4:
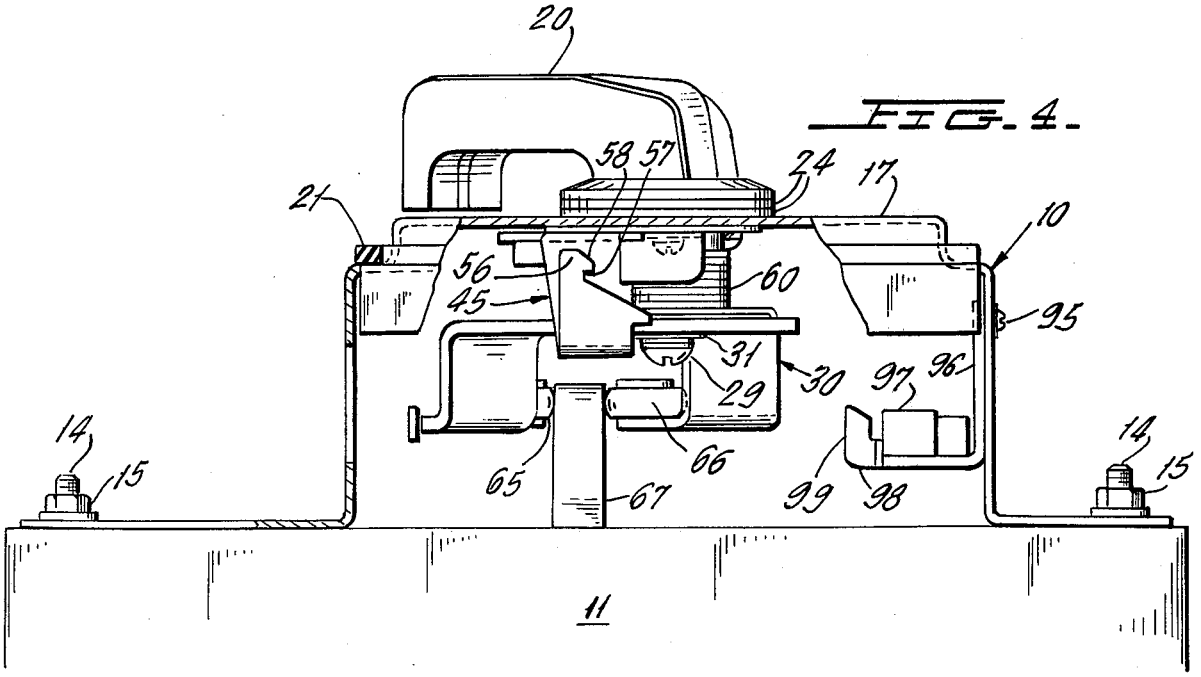
FIG. 4 is a side elevation of the operator mechanism looking in the direction of arrows 4—4 of FIG. 2.
Figure 2:
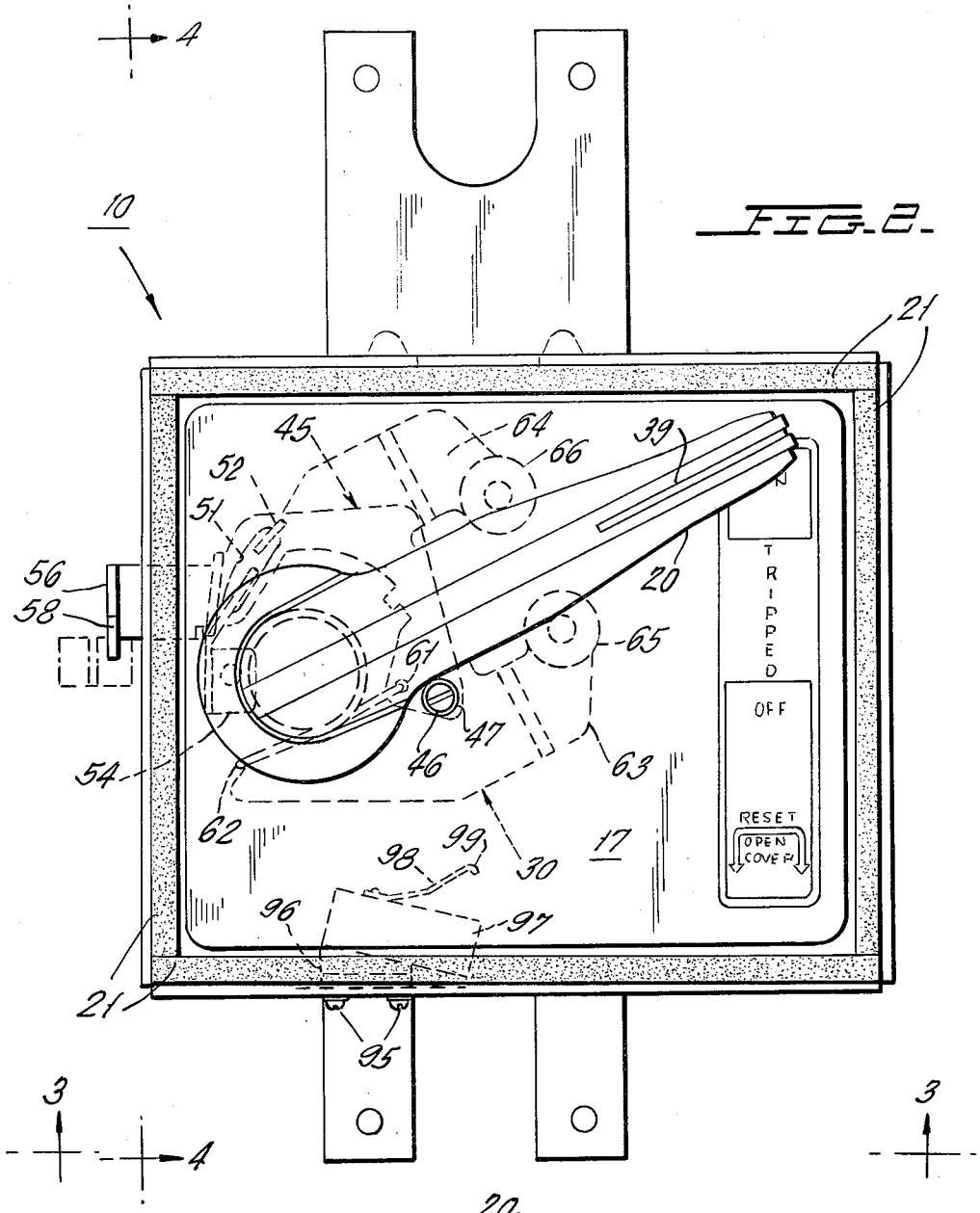
FIG. 2 is a front elevation of the rotary operator mechanism.
Figure 3:
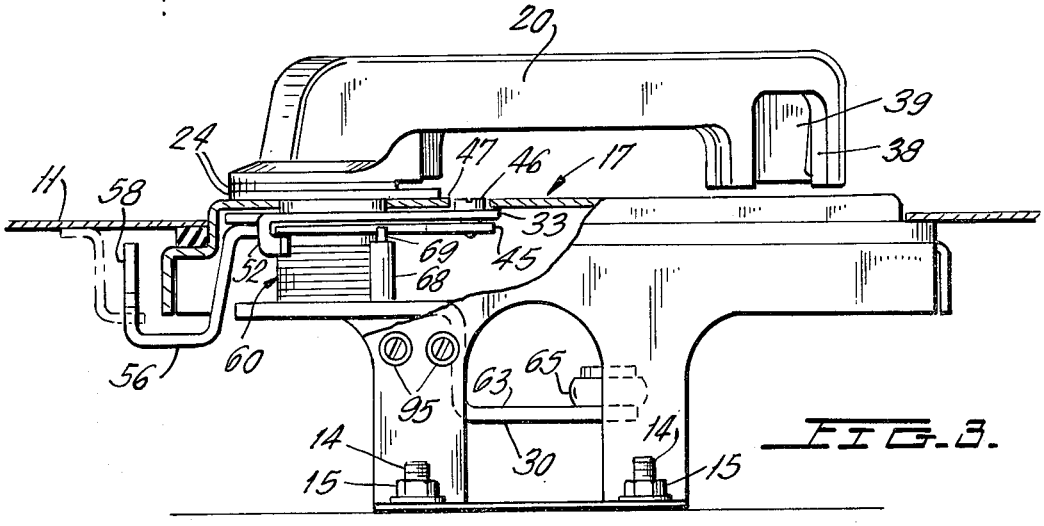
FIG. 3 is an end view of the rotary operator mechanism looking in the direction of arrows 3—3 of FIG. 2.
Figure 5:
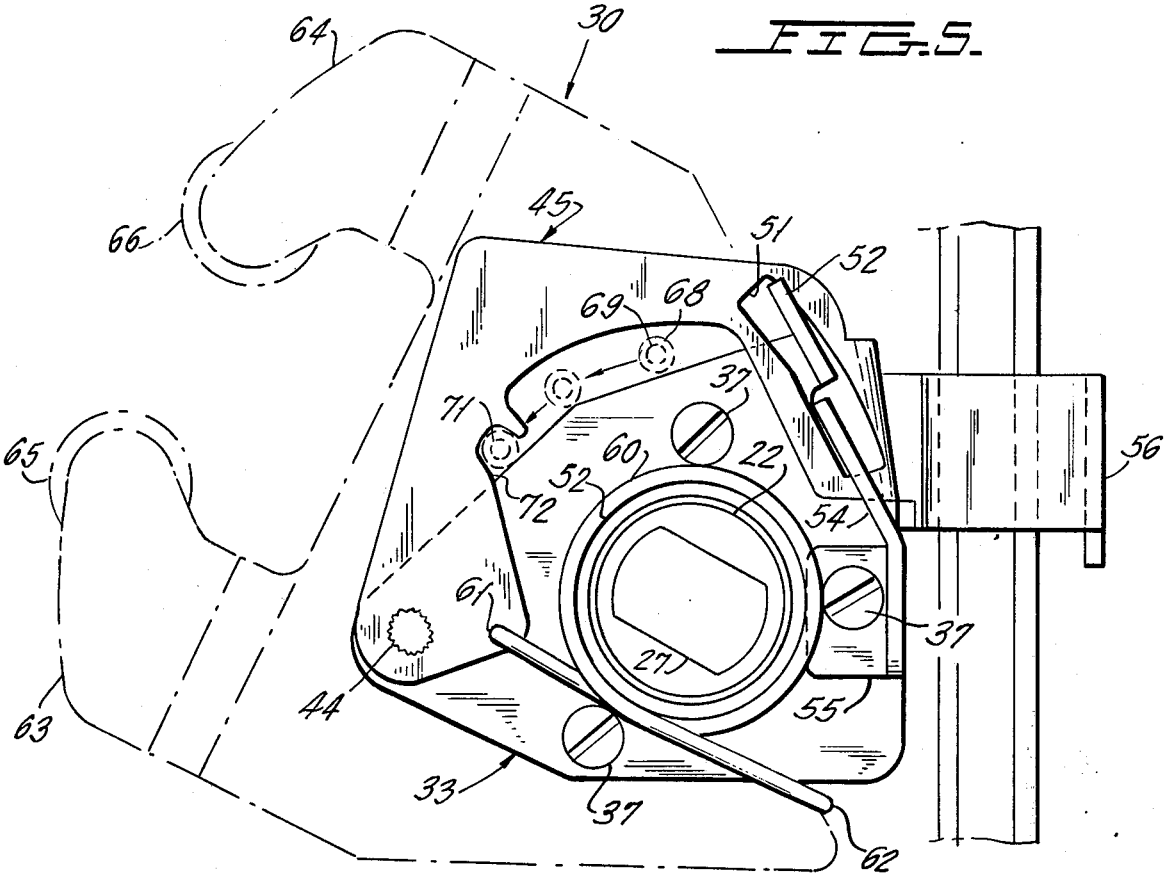
FIG. 5 is a rear view of the cover latch assembly.
Figure 6:
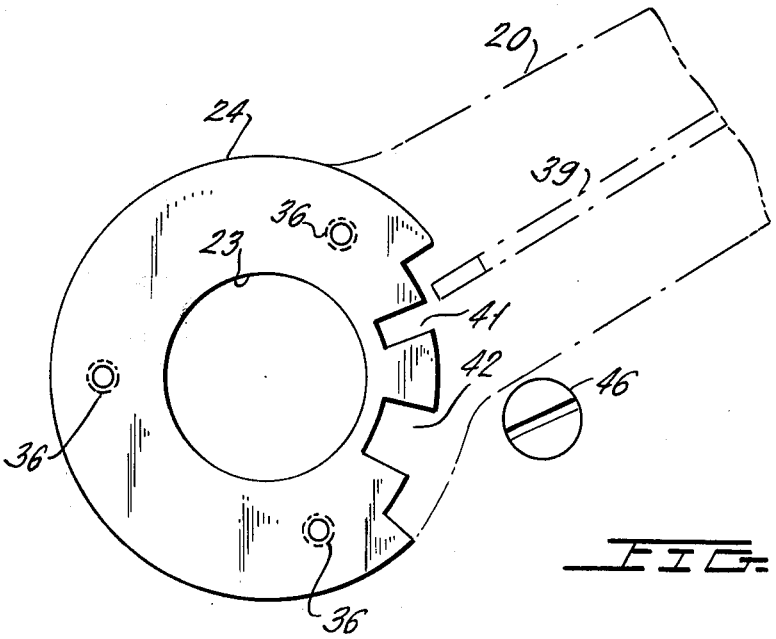
FIG. 6 is a front elevation of one of the spacer-locking discs.

Now referring to the figures. In FIG. 1 molded case circuit breaker 11 is shown disposed within enclosure 12 secured to rear wall 13 by means (not shown). Four sets of studs 14 and bolts 15 secure rotary operator mechanism 10 to the front of circuit breaker 11 in operative position so that when enclosure cover 16 is closed, main section 17 to operator frame 18 will extend through rectangular aperture 19 in cover 16 and manual operating handle 20 is accessible for operation external of enclosure 12. In a manner well known to the art, rectangular gasket 21, cemented to the front of main frame section 17, is engaged by the interior of enclosure door 16 to form a seal blocking the entry of dust into enclosure 12 through aperture 19.

One end of handle 20 is provided with transverse cylindrical bearing part 22 that extends through circular clearance apertures 23 in stacked spacer-locking discs 24, 24, through clearance aperture 25 in main frame portion 17, and through bore **26*a* of bearing sleeve 26 to the rear thereof. Rear end 27 of handle bearing 22 is generally rectangular and is entered into complementary rectangular aperture 28 of cam unit 30, so that the latter is keyed to handle 20. Bolt 29 extends through lock washer 31 and flat washer 32, and is received by a threaded aperture (not shown) at the rear of rectangular formation 27 to secure cam unit 30 to handle 20.**

Figure 9:
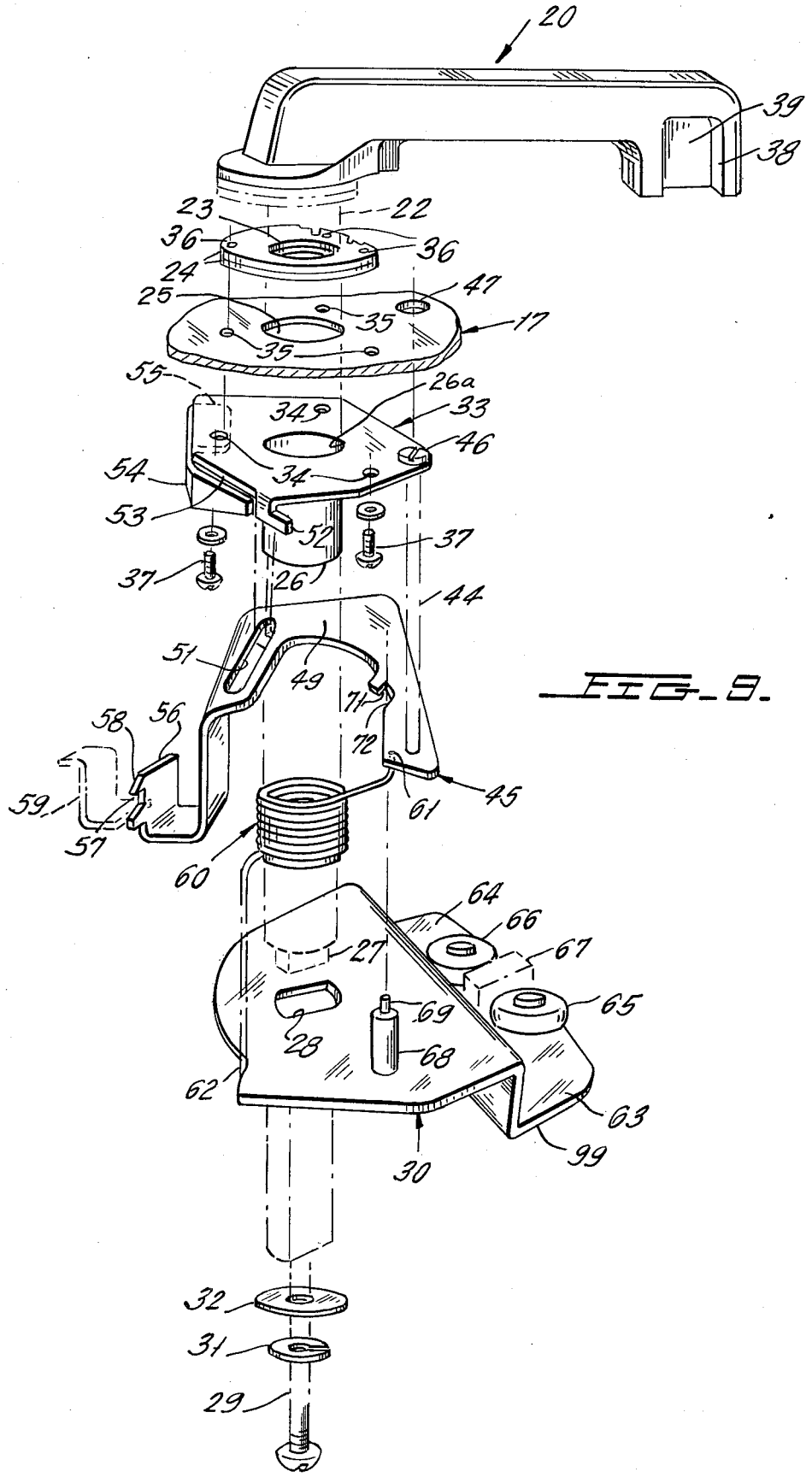
FIG. 9 is an exploded perspective of the main elements of the rotary operator mechanism.

Sleeve 26 extends rearward from mounting plate 33 being fixedly secured thereto. Plate 33 abuts the rear surface of main frame 14, 17 with three clearance apertures 34 in plate 33 aligned with three clearance apertures 35 in main frame portion 17. These apertures 34, 35 are aligned with three threaded apertures 36 in disc 24. Three screws 37 extend through clearance apertures 34, 35 and are received by threaded apertures 36 thereby fixedly securing discs 24, 24 and mounting plate 33 to main frame portion 17. In a manner well known to the art, the end of handle 20 remote from pivot 22 is provided with recess 38 adapted to receive the shackle of a padlock (not shown) when locking slide 39 is moved to the left with respect to FIG. 9 to enter either of the notches 41, 42 in discs 24, 24. With slide 39 entered into either of the notches 41, 42, handle 20 is locked against rotary motion.

Defeater pin 44 is keyed at its rear end to cover latch unit 45. The cylindrical body of pin 44 extends through round clearance aperture (not shown) in mounting plate 33 with slotted head 46 of pin 44 being disposed within circular recess 47 of main frame portion 17, so that defeater pin 46 is accessible for screw driver operation external of enclosure 12. Defeater pin 44 is secured to latch unit 45 at one end of generally U-shaped section 49. Elongated slot 51, at the end of section 49 remote from pin 44, is aligned with rearwardly extending foot 52 of mounting plate 33 with the latter serving to limit pivoting movement of latch unit 45 with respect to mounting plate 33. The portion of latch unit 45 adjacent to slot 51 extends through narrow space 53 formed between support member 54 and the rear of mounting plate 33. One of the screws 37 extends through a clearance aperture in offset foot 55 of support 54 to secure the latter in operative position. Latch unit 45, at a region remote from defeater pin 44, is provided with offset cover latch 56 that is positioned outboard of main frame part 17. Cover latch 56 includes hook-like holding formation 57 and cam surface 58 adjacent to holding formation 57. In a manner well known to the art, when enclosure cover 16 is closed cover latch part 59 mounted to the inside of cover 16 engages cam surface 58 to force latch 56 away from its open cover position and when latch 59 moves to the rear of latch 56 spring 60 forces holding part 57 to a locking position with respect to cover mounted latch part 59 thereby holding cover 16 closed.

Spring 60 is a helix wound about the outside of sleeve 26 with the forward end 61 of spring 60 being secured to latch unit 45 and the rear end 62 of spring 60 being connected to cam unit 30. Thus, spring 60 biases latch unit 45 and cam unit 30 in opposite directions. Cam unit 30 is provided with rearwardly offset spaced arms 63, 64. Rollers 65, 66, freely mounted at the free ends of the respective arms 63, 64, are positioned on opposite sides of circuit breaker handle 67 to transmit rotary motion of handle 20 in a plane generally parallel to rear enclosure wall 13 into limited substantially linear motion of circuit breaker handle 67.

Pin 68 is secured at its rear end to cam unit 30 and at its forward working end 69 is of reduced diameter. Working end 69 cooperates with formations of latch unit 45 to perform a switch interlock function and a cover latch release function. That is, with cover 16 open, spring 60 moves latch unit 45 to a position wherein working tip 69 is disposed within holding notch 71 in latch unit 45, so that an attempt to move handle 20 to circuit breaker closing position with cover 16 open is prevented in that working end 69 of pin 68 is locked against moving out of notch 71. The closing of cover 16 with cover mounted latch part 59 engaging latching part 56 of unit 45 causes limited pivotal movement of latch unit 45 to a position where working tip 69 is clear of notch 71. At this time moving of handle 20 into circuit breaker closing position is permitted.

With cover 16 closed, movement of handle 20 to its extreme position remote from the circuit breaker arm position causes working tip 69 to engage latch unit surface 72 in a camming action. This pivots latch unit 45 disengaging its cover latch 56 from cover mounted cover latch part 59, so that cover 16 may be opened.

Figure 7:
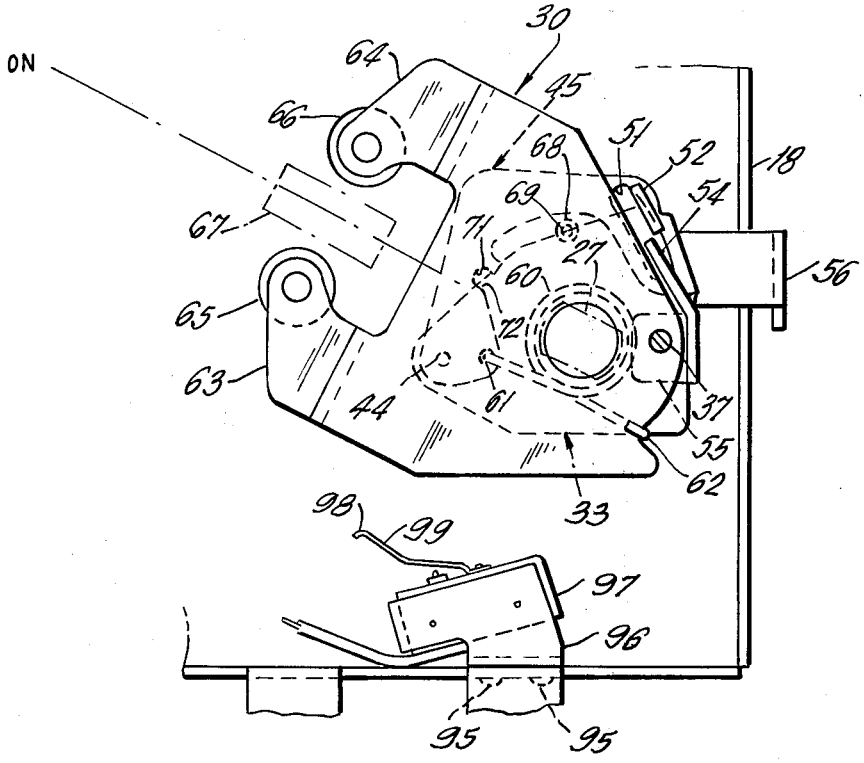
FIGS. 7 and 8 are fragmentary rear elevations of the operator mechanism.
Figure 8:
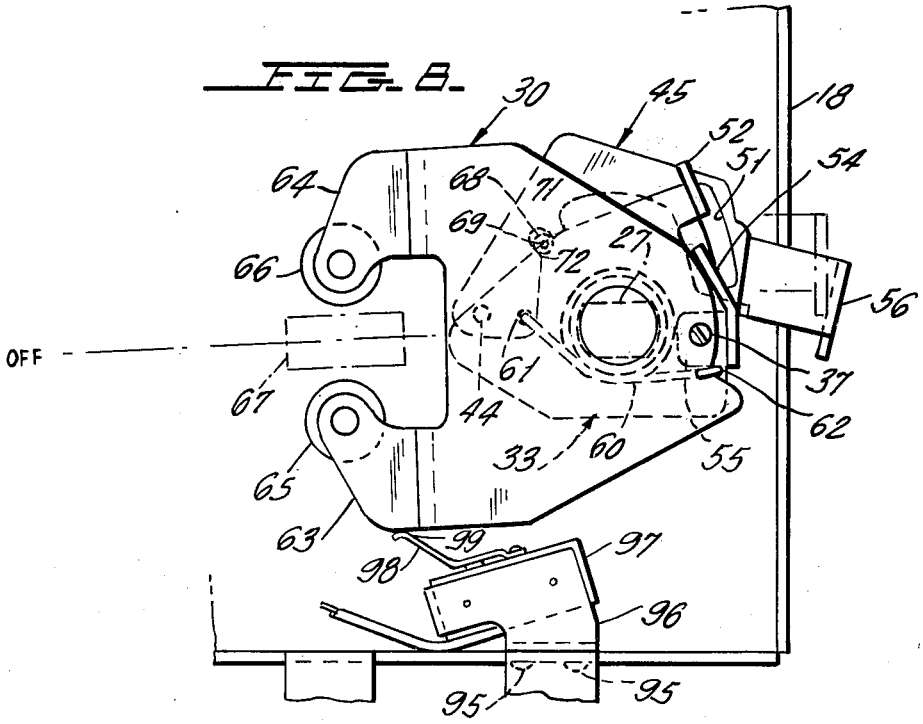

In the OFF position for handle 20 edge portion 99 of cam unit leg 63 engages and deflects leaf spring 98 of auxiliary switch 97 to operate the latter from its normal position of FIG. 7, where spring 98 is freed of engagement by cam unit 30. Auxiliary switch 97 is mounted to bracket 96 and is installed in the field very readily by utilizing a pair of screws 95, 95, extending through clearance apertures in an edge portion of operator mechanism frame 18. It is noted that main frame portion 17 is positioned substantially forward of circuit breaker 11 and that the sides of frame 18 are substantially open so that the operating elements of rotary handle mechanism 10 may be readily examined initially. For applications where mechanism 10 is utilized with a circuit interrupter having an open front, visual observation may readily be had of contact position.

Although there have been described preferred embodiments of this novel invention, many variations and modifications will now be apparent to those skilled in the art. Therefore, this invention is to be limited not by the specific disclosure herein, but only by the appending claims.

The embodiments of the invention in which an exclusive privilege or property is claimed are defined as follows:

1. Circuit breaker operator mechanism including a frame constructed to be fixedly mounted to an enclosure having a circuit breaker therein with a main section operatively positionable in front of and generally parallel to a circuit breaker housing surface having an operating handle extending forward thereof, a main operating handle including a manually engageable portion positioned in front of said main section and pivotally mounted with respect thereto, a cam unit disposed to the rear of said main section and connected to said main operating handle for operation thereby about a main axis generally at right angles to said main section, said cam unit including a portion engageable with a circuit breaker handle mounted for movement in a plane generally at right angles to said main section, a latch unit positioned behind said main section and including a cover latch portion for engaging and holding closed a cover of a circuit breaker enclosure, said cam unit including means to engage said latch unit and operate said cover latch portion to a cover releasing position when said main operating handle is in a first position, biasing means urging said latch unit to a blocking position, said cam unit having means engageable with said latch unit in its blocking position to prevent operation of said main operating handle to a second or circuit breaker closing position, said latch unit being moved to an unblocking position by engagement of said cover latch portion with an enclosure cover when the latter is in its closed position.

2. A circuit breaker operating mechanism as set forth in claim 1 in which a common element extending generally perpendicular to the main section constitutes the means of the cam unit to operate the cover latch portion to cover releasing position and also constitutes the means of the cam unit to prevent operation of the main operating handle to circuit breaker closing position.

3. A circuit breaker operating mechanism as set forth in claim 1 in which the latch unit is pivotally mounted to the main section about an auxiliary axis parallel to and laterally offset from said main axis.

4. A circuit breaker operating mechanism as set forth in claim 2 in which the latch unit is pivotally mounted to the main section about an auxiliary axis parallel to and laterally offset from said main axis.

5. A circuit breaker operating mechanism as set forth in claim 4 in which the common element is pin-like and the latch unit is provided with a cam formation engaged by said common element to pivot said latch unit about said auxiliary axis to said unlocking position.

6. A circuit breaker operating mechanism as set forth in claim 1 in which the frame includes legs extending rearward from the main section to operatively space the main section by a substantial distance from the front of a circuit breaker housing and provide substantial open areas at the sides and ends of main section for viewing the top of a circuit breaker.

7. A circuit breaker operating mechanism as set forth in claim 1 also including auxiliary switch means mounted to the frame at the rear of said main section and operatively positioned for operation by the cam unit.

8. A circuit breaker operating mechanism as set forth in claim 6 also including auxiliary switch means mounted to the frame at the rear of said main section and operatively positioned for operation by the cam unit, a common element extending generally perpendicular to the main section constituting the means of the cam unit to operate the cover latch portion to cover releasing position and also constituting the means of the cam unit to prevent operation of the main operating handle to circuit breaker closing position.

9. A circuit breaker operating mechanism as set forth in claim 8 in which the latch unit is pivotally mounted to the main section about an auxiliary axis parallel to and laterally offset from said main axis.

10. A circuit breaker operating mechanism as set forth in claim 9 in which the common element is pin-like and the latch unit is provided with a cam formation engaged by said common element to pivot said latch unit about said auxiliary axis to said unlocking position.

* * * * *